US005114003A

United States Patent [19]

Jackisch et al.

[11] Patent Number: 5,114,003

[45] Date of Patent: May 19, 1992

[54] TABLET VIAL WITH DESICCCANT IN BOTTOM

[75] Inventors: David A. Jackisch; Ralph F. May, both of Wilmington; Kevin D. Berl, Claymont, all of Del.

[73] Assignee: E. I. Du Pont de Nemours and Company, Wilmington, Del.

[21] Appl. No.: 677,014

[22] Filed: Mar. 28, 1991

[51] Int. Cl.[5] ..... B65D 81/26

[52] U.S. Cl. ..... 206/204; 53/400; 53/428; 206/540

[58] Field of Search ..... 53/167, 396, 400–402, 53/410, 428, 431, 432, 435, 449; 206/204, 528, 538, 540

[56] References Cited

U.S. PATENT DOCUMENTS

| | | | |
|---|---|---|---|
| 2,524,162 | 10/1950 | Chavannes et al. | 53/449 |
| 4,898,273 | 2/1990 | Kristiansen | 206/204 |
| 4,964,509 | 10/1990 | Insley et al. | 206/204 |

FOREIGN PATENT DOCUMENTS

| | | | |
|---|---|---|---|
| 2116742 | 11/1972 | Fed. Rep. of Germany | 206/540 |
| 1182739 | 1/1959 | France | 206/204 |
| 0711186 | 6/1954 | United Kingdom | 206/204 |

OTHER PUBLICATIONS

"Desiccant Doubles as Mechanical Component", Multiform Desiccant Products Inc., Chemical Engineering, Jul. 7, 1970, 200–204.

*Primary Examiner*—Jimmy G. Foster
*Attorney, Agent, or Firm*—R. Thomas Gallegos

[57] ABSTRACT

A vial for housing hygroscopic materials such as tableted chemicals contains a desiccant canister secured to the inside at its base. The desiccant canister is punctured immediataly prior to use. The vial containing hygroscopic materials is sealed with a lid that resists the entrance of water vapor into the vial.

4 Claims, 1 Drawing Sheet

TABLET VIAL WITH DESICCCANT IN BOTTOM

BACKGROUND OF THE INVENTION

Desiccants are widely used in connection with hygroscopic chemicals to prevent or retard the problem of degradation of these chemicals. Typically the problem is solved by building very expensive humidity controlled rooms in which tablets or powders are packaged into vials which are then sealed against moisture. The problem may also be solved by providing a desiccant canister which is permanently open to expose it to the surrounding air in a vial containing tablets. The canister itself must be protected from moisture until it is placed in the vial either at a packaging facility or at the pharmacy. The desiccant could also be incorporated into the closure (lid) such as is done in the U.S. with certain chemicals. This method is widely used in Europe for effervescent products using friction-type closures. In either case, the desiccant can become separated from the product, exposing the product to moisture. The desiccant itself, prior to use, must be carefully packaged to avoid moisture exposure that would diminish its effectiveness.

DE 3,622,773 discloses a plastic stopper closure with a dryer insert that may be pressed into the opening of a container such as a tube or bottle. This stopper seals to the inner surface of the container and is filled with a drying agent which is held in place by a disk. DD 148,749 discloses a plastic closure for medication bottles consisting of a hollow elastic stopper containing an elastic telescoping insert filled with stabilizer.

SUMMARY OF THE INVENTION

The present invention solves the problem of protecting hygroscopic chemicals by providing a desiccant canister which is filled with fresh desiccant and immediately sealed against moisture. The sealed canister is placed in the base of the tablet container. Immediately before the tablets are placed in the container the desiccant canister is punctured to expose the desiccant to the air in the container. Tablets are then placed in the container and the container is sealed against the ambient air. This method provides excellent protection for hygroscopic chemicals. At the same time it avoids the necessity of expensive humidity control in the packaging facility, and the necessity of protecting a porous desiccant canister until it is placed in use and sealed. This method has the added advantage over containers having desiccant canisters in the lid, that an additional moisture seal or tamper evident seal may be placed over the lip of the container before the lid is put in place.

The containers of this invention are useful for containing hygroscopic materials such as agricultural or medicinal compositions, ensuring both moisture resistance and tamper evidence to the contents of the package.

This invention pertains to a container or package containing sealed desiccant canister.

This invention also pertains to a container or package in which a desiccant (drying agent) canister is attached to the inside in such a way that any water in the product or water vapor in the container can diffuse into the desiccant. This invention also pertains to a process for making this container or package.

The container can be any shape or size such as a jar, vial, bottle, tube, etc. The material of construction can be anything that is relatively impermeable to water vapor such as glass, plastic, metal, foil-lined paperboard, etc.

The drying agent can be anything that is approved for use with the product. Adsorbants such as montmorillonite clay, silica gel, molecular sieves, CaO, $CaSO_4$, $CaCl_2$ can all be used.

The desiccant is secured to the inside of the container in such a way that it stays with the container when the product is removed. The desiccant could be put in a cylindrical container or canister and pressed or glued into the bottom of the container. It could be a doughnut-shaped piece or it could be made an integral part of the container.

The value of the invention is increased by protecting the desiccant from ambient air until just before the product is put into the container. The drying agent can be sealed with a metal foil or plastic lid which can be punctured just before use to expose the desiccant.

The contents need to be protected from humid air leaking into the container. A moisture-proof lid (closure) could be heat sealed to the top of the container. Another way would be to use a closure that was essentially air tight. This could be done by using several threads, fine threads, soft closure liner, external seal, etc.

This invention pertains to a package comprised of the following:

1. a vial;
2. a covered or packaged desiccant attached to the inside of the vial;
3. an optional moisture-resistant and tamper-resistant seal attached to the lip of the vial to protect the contents; and
4. a lid closing the vial.

DETAILED DESCRIPTION OF THE INVENTION

This invention puts a drying agent (desiccant) in a container so that: the desiccant will not fall out; the container can have a moisture-proof tamper-evident seal; and the desiccant is exposed to the air only just before use.

Figure 1:
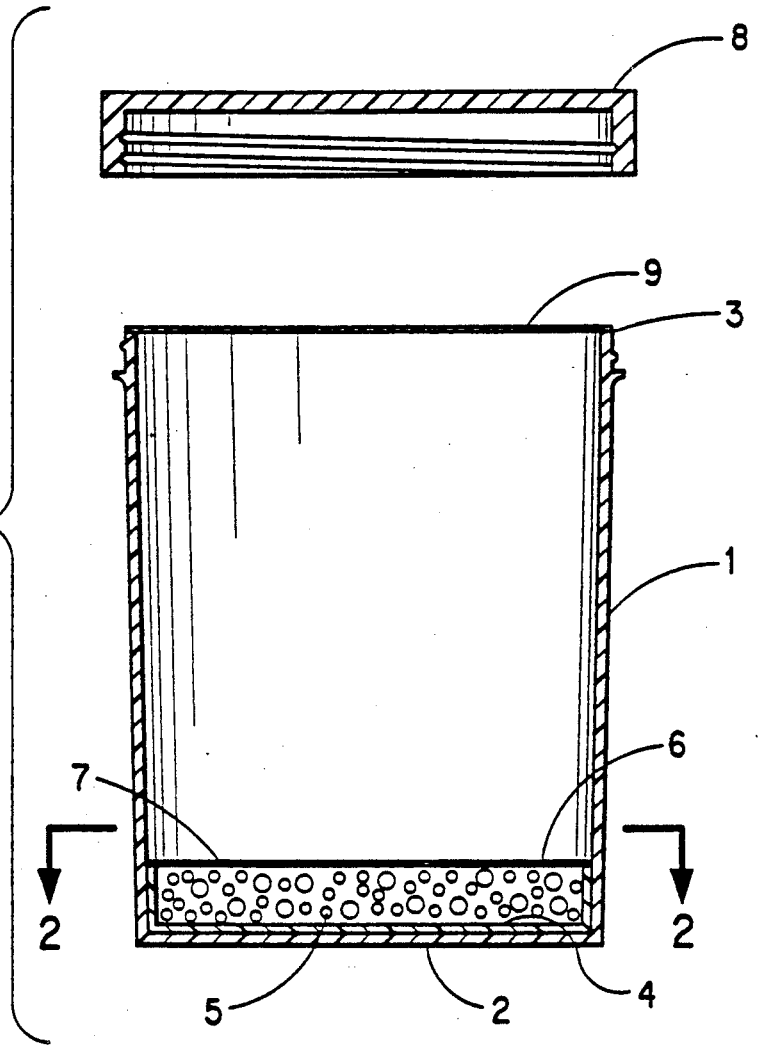
FIG. 1 is a side view of the container.

As shown in FIG. 1, the container may be a cylindrical vial (1) having a closed end (bottom) (2) and an open end (top) (3). The container may be of glass, metal, plastic, foil-lined paperboard or any material suitable for the purpose. A desiccant canister (4) is secured to the inside of the cylinder (1). The desiccant canister may be of any material that forms a barrier to water vapor. The entire canister may be foil or polymer material, or may be a rigid material with a foil or polymer film seal. The desiccant canister (4) contains a desiccant (drying agent) material (5), usually in the form of beads or granules. Desiccant materials are well known in the art. Among the typical desiccants are montmorillonite clay, silica gel, molecular sieve, CaO, $CaSO_4$ and $CaCl_2$. The choice of desiccant material is not critical to this invention. The amount of desiccant is determined by the needs of the user. The desiccant canister (4) of this invention is closed with a seal (6) immediately after the desiccant (5) is placed in it. The seal (6) prevents the entrance of water vapor before the desiccant (5) is intended to be used. The seal (6) may be of any material that will prevent the passage of water vapor across it. Polymer films and metal foils are commonly used. The canister (4) remains sealed until immediately prior to placing contents in the container (1). The contents may be tablets or other material which must be dried or kept dry. Such materials are usually pressed dried chemicals or mixtures. They may be pharmaceutical or over-the-counter drugs in tablet form. They may also be herbicides or pesticides.

Figure 2:
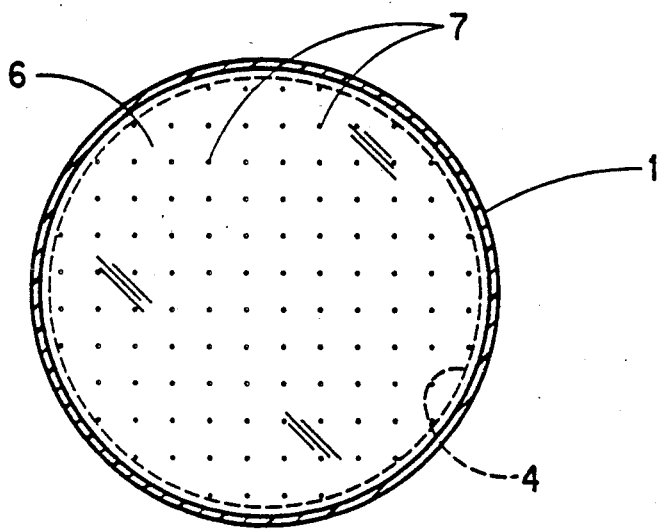
FIG. 2 is a plain view of the desiccant canister showing holes after being punctured.

Immediately prior to placing the tablets in the container (1) the seal (6) on the canister (4) is punctured (perforated) to expose the desiccant (5) (FIG. 2). The only requirement is that the holes (7) made by the puncture are large enough to allow water vapor to pass through, but smaller than the desiccant granules.

"Immediately prior" means specifically that under the conditions of humidity in the packaging facility during packaging the performance of the desiccant capacity will not be substantially reduced between the time the canister is punctured and the time the container is filled and sealed.

The container is closed with a lid (8) immediately after the contents are placed into it. The lid (8) can be any lid which provides a reliable closure. The lid (8) may be a friction fit or it may be threaded to match threads on the container. An optional seal (9) may be placed over the open end (3) of the container (1) to provide additional protection against water vapor entering the container (1). The seal (9) also may provide evidence of tampering with the contents. A broken seal (9) evidences that the container (1) has been opened and (3) may give evidence that contents have been removed or that the contents may be unreliable at the point of purchase. The seal (9) may be any water barrier material such as polymer film or a metal foil. The seal (9) can be heat sealed to the open end (3) of the container (1) before the lid (8) is put on. The seal (9) can also be put on with the lid (8) and induction sealed to the open end (3) of the container (1) later. The seal (6) and the seal (9) are understood to have the ability to prevent water vapor from passing across them. Therefore, they may be made of a foil or a film or a combination of materials known to one skilled in the art for the purpose of forming a barrier against water vapor.

The configuration and size of the container, the placement of the desiccant canister, the amount of desiccant, the size of the holes in the desiccant seal, and other factors may change with the contents to be housed without departing from this invention.

PREFERRED EMBODIMENT

The preferred embodiment is a vial for housing effervescent herbicide tablets.

A cylindrical vial (1) is illustrated in FIG. 1. It is 65 mm high and has an inside diameter of 45 mm. Such vials are slightly larger at the top (3) than at the bottom (2). Polypropylene is preferred for making the vial.

A standard 43 mm polypropylene cap is used as a desiccant canister (4). The canister (4) is filled with 7 grams of molecular sieves (5). The sieves are type 4A and are 8–12 mesh (1.7–2.4 mm) beads. The lip of the canister is sealed with a foil/polymer film. The seal (6) is made by heat and the outer edges of the film are sealed to the top circumference of the canister (4).

The sealed desiccant canister (4) is pressed into the bottom (2) of the vial (1). Because of the tightness of the fit the desiccant cannot be removed unless the vial (1) is broken.

Just before the vial (1) is filled with effervescent tablets the foil seal (6) is punctured. The tool used makes 17 holes (7) that are 1.0 mm in diameter. The holes (7) are small enough to prevent the desiccant (5) from falling out, but provided enough area to allow water vapor from the product housed in the vial or from the space inside the vial to diffuse into the desiccant (5). The advantage of preparing a sealed, packaged desiccant (5) is that moisture levels in the ambient air are not a concern during vial (1) storage or at any time before the desiccant canister (4) is punctured. Commonly available desiccant canisters have openings and must be carefully stored in dry conditions so that their value isn't lost before the desiccant is used.

The effervescent tablets are put into the vial (1) immediately after the desiccant canister (4) is punctured and the lid (8) is immediately attached. The lid (8) assembly includes a polymer/foil/polymer piece that is 0.38 mm thick. The lid (8) is screwed on tightly and the seal (9) is sealed by induction heating. The seal (9) is moisture-proof and provides tamper evidence.

The present invention provides the advantages of a canister containing that fresh desiccant has been stored without the need for special dehumidification of the packaging facility or storage room; the desiccant is not separatable from the container; and in the case of effervescent tablets, the desiccant dries the tablets during storage, prolonging the shelf life of the tablets.

PROCESS DESCRIPTION

The first step is to fill the desiccant canister (4) with the desiccant (5). The amount of desiccant to be used will depend on the diameter and depth of the canister. The desiccant should almost fill the cavity, but not be above the edge of the canister. The desiccant can be weighed out or measured by volume with a measuring spoon or cup. The desiccant used must be greater in diameter than the holes that will be punched in the canister lid later.

The desiccant will be exposed to ambient relative humidity during this step. If the relative humidity is less than 30–40% there is little concern with speed in assembly. If the relative humidity is greater than 40% the time that the desiccant is exposed will have been kept down to just a few minutes so that the desiccant's capacity is not reduced by picking up water from the air.

The canister is tapped lightly to make sure the desiccant is level. The seal is placed on top of the canister. This is easiest to do if the seal is formed with a lip on it so that it will be automatically centered on the canister. The seal is made preferably with a conduction heat sealer. The time and temperature will depend upon the polymer that is used on the seal. In the preferred embodiment the heat sealer was held in direct contact with the seal for 2–3 seconds at a temperature of 220° C.

The canister is placed into the top of the vial (1). It is gently pushed down by hand until resistance is met. Care must be taken to be sure the desiccant canister is kept level. The canister is then pushed to the bottom of the vial with a cylindrical tool. The tool can be made of any relatively hard material such as wood, plastic, or metal. The tool can be mounted in a leveraged device such as a drill press.

The vial/desiccant combination can be stored for a long period of time (years). It need not be stored in any particular environment.

Immediately prior to placing the tablets in the container the desiccant canister seal is punctured with a tool that has needle-like protrusions. When possible this step should be done within a few minutes of filling the vial. Again the time will depend on the relative humidity and the desiccant type. If the room had a relative humidity of only 15% the canister seal could be pierced 24 hours before the vial is filled. If the relative humidity were 60% it would be best if the seal were punctured no more than 5 minutes before adding the tablets. The tool can have from 1 to 100 spikes, with 15–25 being preferred. The diameter of the spikes has to be smaller than the size of the desiccant used, with 1 mm being preferred. The outside diameter of the tool should be smaller than the inside diameter of the vial. A drill press type machine (as described above for inserting the canister into the vial) can be used to put the holes in the top of the desiccant canister.

The tablets are counted out and placed into the vial one on top of another. The top tablet must be below the top of the vial. A circular foam spacer can be inserted if the empty space is so large that the tablets will move around when the cap is put on.

The vial closure (cap) preferably has the tamper-evident, moisture resistant seal (9) inside. The cap is screwed on to the vial as tightly as possible.

The most convenient way to seal (9) to the vial is by induction sealing. This kind of sealer uses radio frequency energy to melt the polymer on the seal. The frequency used and the time it is on will depend on the polymer used. In the preferred embodiment 275 kHz and 300 watts were used. The load cell is placed on top of the assembled vial for 2 seconds. The vial is allowed to cool at room temperature for 5 minutes before handling it further.

Effervescent tablets packaged by the method of the preferred embodiment and stored in the sealed container showed no degradation after one year.

From the foregoing description, one skilled in the art can easily ascertain characteristics of this invention, and without departing from the spirit and scope thereof, can make various modifications of the invention to adapt it to various uses and conditions.

What is claimed is:

1. A method of protecting hygroscopic materials, comprising:

a) filling a package with desiccant;

b) sealing the package to prevent the entrance of moisture into the desiccant;

c) placing the sealed package in the base of a container;

d) puncturing the desiccant package immediately prior to placing the hygroscopic material in the container;

e) placing the hygroscopic material in the container;

f) placing a lid over the container such that the container is substantially sealed against moisture.

2. The method of claim 1 further comprising after step e) attaching a moisture or tamper resistant seal to the lip of the container.

3. The package of claim 1 further comprising a moisture-proof tamper-evident seal attached to the open end of the container, the seal providing increased protection against moisture entering the package or evidence of tampering if the seal is broken.

4. The package of claim 1 containing hygroscopic materials in the form of tablets.

* * * * *